US008336357B2

(12) United States Patent
Hoshino et al.

(10) Patent No.: US 8,336,357 B2
(45) Date of Patent: Dec. 25, 2012

(54) ROLLER DICE DEVICE, METHOD FOR MANUFACTURING INSULATOR COIL AND WINDING APPARATUS

(75) Inventors: Akinori Hoshino, Nisshin (JP); Tetsuya Morita, Kariya (JP); Hiroaki Yabui, Aichi-ken (JP); Tomoko Hiramatsu, Toyokawa (JP); Hideyuki Aikyo, Kariya (JP); Nobuhisa Nakajima, Chiryu (JP); Shigeharu Yamamoto, Toyota (JP); Yousuke Iguchi, Nagoya (JP)

(73) Assignee: Aisin Seiki Kabushiki Kaisha, Kariya-shi (JP)

( * ) Notice: Subject to any disclaimer, the term of this patent is extended or adjusted under 35 U.S.C. 154(b) by 534 days.

(21) Appl. No.: 12/568,095

(22) Filed: Sep. 28, 2009

(65) Prior Publication Data

US 2010/0084501 A1 Apr. 8, 2010

(30) Foreign Application Priority Data

Oct. 3, 2008 (JP) ..... 2008-258868

(51) Int. Cl.
*A01B 29/06* (2006.01)

(52) U.S. Cl. ..... 72/252.5; 492/1; 492/28

(58) Field of Classification Search ..... 72/252.5, 72/221, 226; 492/1, 2, 28, 36, 38, 39
See application file for complete search history.

(56) References Cited

U.S. PATENT DOCUMENTS

| | | | | |
|---|---|---|---|---|
| 401,692 | A * | 4/1889 | Colley | 72/221 |
| 1,302,497 | A * | 5/1919 | Barbour | 72/377 |
| 2,038,908 | A * | 4/1936 | Scholl | 72/221 |
| 3,228,220 | A | 1/1966 | Schneckenburger | |
| 3,488,989 | A * | 1/1970 | Christine et al. | 72/252.5 |
| 4,622,730 | A | 11/1986 | Steinbock | |
| 7,322,220 | B2 * | 1/2008 | Park et al. | 72/234 |

FOREIGN PATENT DOCUMENTS

| | | |
|---|---|---|
| DE | 92691 | 7/1897 |
| GB | 980362 | 1/1965 |
| GB | 2 156 935 A | 10/1985 |
| JP | 52-129815 | 10/1977 |
| JP | 59-54110 | 4/1984 |
| JP | 59-77507 | 5/1984 |
| JP | 63-40602 | 2/1988 |
| JP | 4-249011 | 9/1992 |
| JP | 10-225713 | 8/1998 |
| JP | 2000-82628 | 3/2000 |
| JP | 2005-209378 | 8/2005 |
| JP | 2007-220490 | 8/2007 |

OTHER PUBLICATIONS

Office Action issued May 31, 2012, in Japanese Patent Application No. 2008-258868, filed Oct. 3, 2008 (with English language translation).

* cited by examiner

*Primary Examiner* — Debra Sullivan
(74) *Attorney, Agent, or Firm* — Oblon, Spivak, McClelland, Maier & Neustadt, L.L.P.

(57) ABSTRACT

A roller dice device includes a pair of rolling rollers respectively including circumferential rolling grooves formed at outer circumferential surfaces thereof, a supporting portion rotatably supporting the pair of rolling rollers respectively around roller axes extending in parallel with each other, a spaced portion configured by a rolling portion, through which a rolling material moves, and formed by the circumferential rolling grooves facing each other, and a restricting portion formed at the outer circumferential surfaces of the pair of the rolling rollers and restricting displacement of the pair of rolling rollers relative to each other in the axial direction of the roller axes.

1 Claim, 3 Drawing Sheets

ROLLER DICE DEVICE, METHOD FOR MANUFACTURING INSULATOR COIL AND WINDING APPARATUS

CROSS REFERENCE TO RELATED APPLICATIONS

This application is based on and claims priority under 35 U.S.C. §119 to Japanese Patent Application 2008-258868, filed on Oct. 3, 2008, the entire content of which is incorporated herein by reference.

TECHNICAL FIELD

This disclosure relates to a roller dice device, a method for manufacturing an insulator coil and a winding apparatus.

BACKGROUND

A rolling material may not be processed accurately by means of a roller dice device, in a case where circumferential rolling grooves of a pair of rolling rollers are displaced relative to each other in a width direction of the grooves. A roller dice device is disclosed in JP10-225713A, in which positions of roller axes of rolling rollers are fixed in an axial direction thereof so as not to allow displacement of circumferential rolling grooves relative to each other in a width direction of the grooves. Further, according to JP2007-220490, in order to form a wire, having a substantially circular-shaped cross-section, into a rectangular wire, having a substantially rectangular-shaped cross-section, a first pair of rollers forms two sides, facing each other in a radial direction of the wire, and a second pair of rollers forms the other two sides, facing each other in a radial direction of the wire.

According to JP10-225713A, when a rolling material moves through a rolling portion, the rolling material contacts the circumferential rolling grooves. At that time, a reaction force, which includes a component force in the axial direction of the rolling rollers, may be applied to each of the circumferential rolling grooves of the pair of rolling rollers. Consequently, moment is generated, which causes displacement of outer circumferential surfaces of the rolling rollers relative to each other in the axial direction of the roller. Accordingly, the circumferential rolling grooves may easily be displaced relative to each other in the width direction of the grooves. Further, according to JP2007-220490, in order to form the rectangular wire, having the rectangular-shaped cross-section, the first pair of rollers for rolling longer sides may include greater thickness and greater rigidity than the second pair of rollers for rolling shorter sides. However, in order to form a rectangular wire, whose shorter sides are narrow in width (for example, a rectangular wire whose shorter sides are 1 mm or less in width), a width of a pair of rollers for rolling the shorter sides is required to be narrow so as to correspond to the width of the shorter sides. Consequently, a rigidity of the pair of rollers for rolling the shorter sides may be reduced, and as a result, accuracy in forming the rectangular wire may be reduced.

A need thus exists for a synchronous motor control device that is not susceptible to the drawback mentioned above.

SUMMARY

According to an aspect of this disclosure a roller dice device includes a pair of rolling rollers respectively including circumferential rolling grooves formed at outer circumferential surfaces thereof, a supporting portion rotatably supporting the pair of rolling rollers respectively around roller axes extending in parallel with each other, a spaced portion configured by a rolling portion, through which a rolling material moves, and formed by the circumferential rolling grooves facing each other, and a restricting portion formed at the outer circumferential surfaces of the pair of the rolling rollers and restricting displacement of the pair of rolling rollers relative to each other in the axial direction of the roller axes.

The foregoing and additional features and characteristics of the disclosure will become more apparent from the following detailed description considered with the reference to the accompanying drawings, wherein.

DETAILED DESCRIPTION

Embodiments of a roller dice device A, a method for manufacturing an insulator coil and a winding apparatus B will be described hereinafter with reference to the attached drawings.

[First Embodiment]

Figure 1:
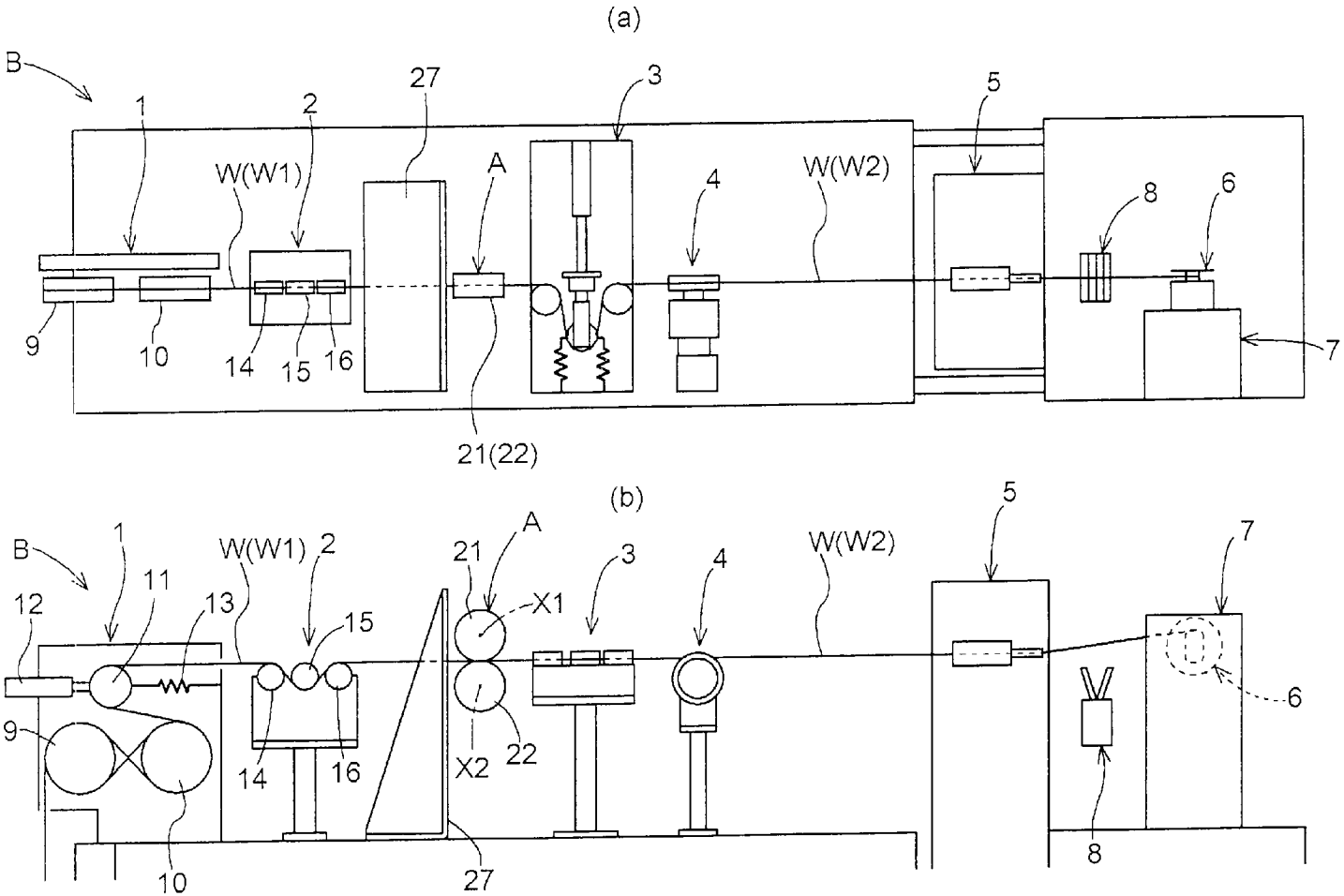
FIG. 1A is a planar view illustrating a winding apparatus.
FIG. 1B is a side view illustrating the winding apparatus.

FIG. 1 illustrates the winding apparatus B for manufacturing the insulator coil. In order to manufacture the insulator coil, a first wire W1 (a wire for an insulator coil, a rolling material) is rolled to be formed into a second wire W2 (a rolled wire), having a substantially rectangular-shaped cross section, and then the second wire W2 is wound around a bobbin 6. The winding apparatus B includes the roller dice device A.

The winding apparatus B includes, from an upstream in a reeling off direction of a wire W (i.e. from a front side of the winding apparatus B), a servo tension device 1, a tension measure 2, the roller dice device A, a winding speed measuring device 4, a nozzle unit 5, a spindle unit 7 and a tension device 3. The servo tension device 1 is a wire reeling device for reeling off the first wire W1, having a circular-shaped cross-section. The tension measure 2 detects a tension of the first wire W1. The roller dice device A rolls the first wire W1, having a substantially circular-shaped cross-section, to be formed into a second wire W2, having the substantially rectangular-shaped cross-section. The winding speed measuring device 4 detects a winding speed of the second wire W2. The nozzle unit 5 directs the second wire W2, which flows through the nozzle unit 5. The spindle unit 7 (a winding device) winds the second wire W2 around the bobbin 6 so as to form the insulator coil. The tension device 3 (a tension adjusting device) adjusts a tension of the second wire W2, which flows from the roller dice device A to the spindle unit 7.

A tying device 8 for tying up the second wire W2 is provided between the nozzle unit 5 and the spindle unit 7. However, not limited to the first embodiment described herein, the tension measure 2, the tension device 3 and the tying device 8, for example, may be selectively provided.

The servo tension device 1 is provided at a front side of the winding device B while the spindle unit 7 is provided at a rear side of the winding device B. Directions, such as front, rear, left and right used hereinafter correspond to front, rear, left and right sides of the winding device B, respectively.

A manufacturing operation for manufacturing the insulator coil performed by the winding apparatus B includes a wire supplying process, a rolling process and a winding process. The processes are performed as a single-series operation, in which the wire W (the first and second wires W1, W2) are neither removed nor placed in a middle of the operation. The wire supplying process is a process for reeling off the first wire W1 by means of the servo tension device 1 and supplying the reeled first wire W1 to the roller dice device A. The rolling process is a process for rolling the first wire W1 to be formed into the second wire W2, having the rectangular-shaped cross-section, by means of the roller dice device A. The winding process is a process for winding the second wire W2 around the bobbin 6 by means of the spindle unit 7 so as to form the insulator coil. However, not limited to the first embodiment, the reeling process, for example, may not be necessarily provided and the first wire W1 may be supplied only when a tension of the first wire W1 exceeds a predetermined value.

The first wire W1, having the circular-shaped cross-section, is supplied from a wire supplying reel, and is wound around the servo tension device 1. The servo tension device 1 includes a first reeling roller 9, a second reeling roller 10 and a tension roller 11. The reeling rollers 9, 10 reel off the first wire W1 when one of the reeling rollers 9, 10 is driven by a servo motor. The reeled first wire W1 is wound around the tension roller 11 that is provided at an upper side of the reeling rolls 9, 10.

The tension roller 11 includes a spring 13, which is held by a low-friction cylinder 12 to be movable in a front-rear direction. The tension roller 11 applies tension to the first wire W1 by means of the spring 13.

The tension roller 11 reels off the first wire W1 from an upper portion thereof toward a rear direction. The tension roller 11 stabilizes the tension of the first wire W1 specifically when a winding speed is high.

The tension measure 2 includes a front roller 14, an intermediate roller 15 and a rear roller 16, around each of which the first wire W1, reeled off from the tension roller 11, is wound. The first wire W1 is wound around an upper side of the front roller 14, a lower side of the intermediate roller 15 and an upper side of the rear roller 16.

Each of the rollers 9, 10 of the servo tension device 1 and each of the rollers 14, 15, 16 of the tension measure 2 is formed with a groove, having a semicircular-shaped cross-section, at each outer circumferential portion thereof, so that the first wire W1, having the circular-shaped cross-section, is guided without getting damaged.

Figure 2:
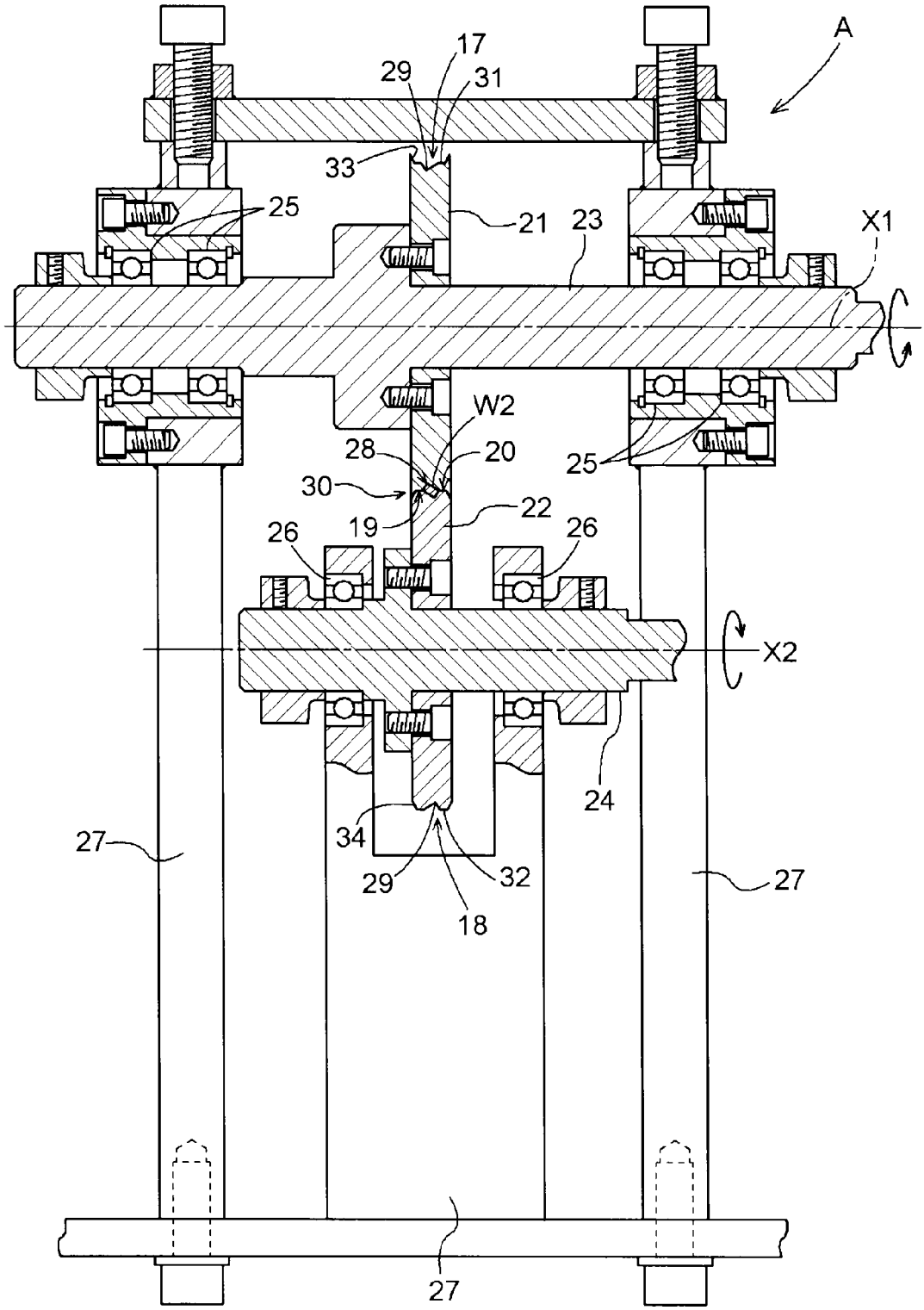
FIG. 2 is a front view illustrating a roller dice device.
Figure 3:
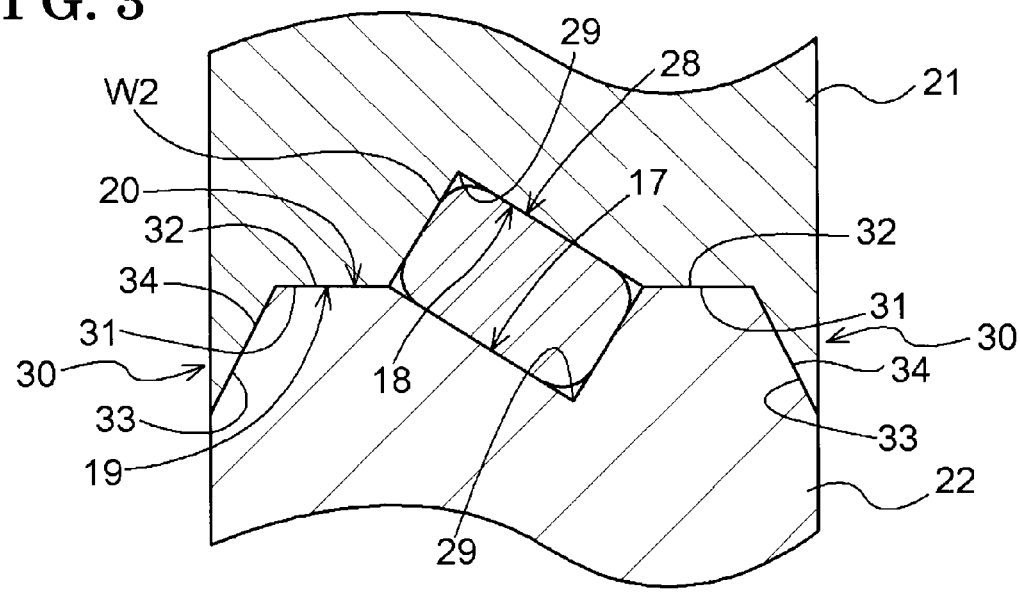
FIG. 3 is an enlarged view illustrating a main portion.

The roller dice device A, as illustrated in FIGS. 2 and 3 includes a pair of rolling rollers 21, 22 (an upper rolling roller 21 and a lower rolling roller 22), a first rotational shaft 23, a second rotational shaft 24 and a supporting frame (a supporting portion) 27. The pair of rolling rollers 21, 22 are respectively formed with first and second circumferential rolling grooves 17, 18 at first and second outer circumferential surfaces 19, 20 thereof. The pair of rolling rollers 21, 22 are respectively fixed to the rotational shaft 23, 24 by means of bolts so as to be attached/detached. The supporting frame 27 respectively rotatably supports the rotational shafts 23, 24 of the pair of rolling rollers 21, 22 around first and second roller axes X1, X2, which extend in a horizontal direction to be parallel with each other, via first and second bearings 25, 26, respectively.

The pair of rolling rollers 21, 22 are rotatably supported by the supporting frame 27 via the rotational shafts 23, 24 and the first and second bearings 25, 26, so that the outer circumferential surfaces 19, 20 thereof contact each other in a radial direction of the rolling rollers 21, 22. As illustrated in FIG. 3, a spaced portion, formed by the circumferential rolling grooves 17, 18 facing each other, is configured by a rolling portion 28, through which the wire W moves.

The circumferential rolling grooves 17, 18 of the pair of rolling rollers 21, 22 are coated by a coating material in order to improve abrasion resistance and slidability.

The pair of rolling rollers 21, 22 are supported so that the lower rolling roller 22 is driven to rotate by means of a servo motor while the upper rolling roller 21 is driven to rotate when the upper rolling roller 21 contacts the wire W moving through the rolling portion 28.

Each of the circumferential rolling grooves 17, 18 is formed to have a substantially right-triangle-shaped cross-section so that the rolling portion 28 is formed into a substantially rectangular-shaped hole when seen in a moving direction of the wire W.

More specifically, in order to form the rolling portion 28 in the rectangular-shaped hole when seen in the moving direction of the wire W, each of the circumferential rolling grooves 17, 18 is formed to have substantially the same inequilateral-right-triangle-shaped cross-section, and first and second corner portions 29 of bottom surfaces of the inequilateral-right-triangle-shaped circumferential rolling grooves 17, 18 are displaced in a width direction of the circumferential rolling grooves 17, 18.

Figure 4A:
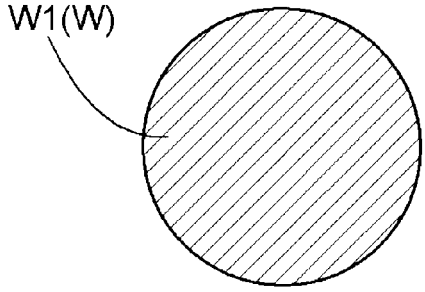
FIG. 4A is a cross-sectional view illustrating a wire that is not yet rolled.
Figure 4B:
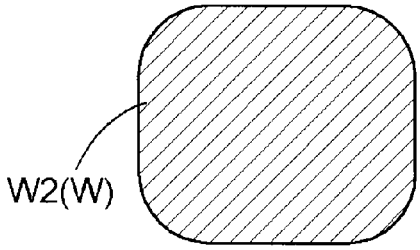
FIG. 4B is a cross-sectional view illustrating a wire that has been rolled.

While the first wire W1, having the circular-shaped cross-section, is moving through the rolling portion 28 as illustrated in FIG. 4A, the first wire W1 is rolled to be formed into the second wire W2, having the rectangular-shaped cross-section whose corner portions are rounded.

A restricting portion 30 is formed at the outer circumferential surfaces 19, 20 of the pair of the rolling rollers 21, 22. The restricting portion 30 restricts displacement of the pair of rolling rollers 21, 22 relative to each other in an axial direction of the roller axes X1, X2.

The first outer circumferential surface 19 of the upper rolling roller 21 and the second outer circumferential surface 20 of the lower rolling roller 22 are engaged with each other in the radial direction of the rolling rollers 21, 22 at the rolling portion 28. Thus, the restricting portion 30 is configured to restrict the displacement of the pair of rolling rollers 21, 22 in the axial direction.

The first outer circumferential surface 19 of the upper rolling roller 21 is formed with a groove that is formed into a substantially trapezoid shape when seen in the cross-sectional view. The first outer circumferential surface 19 of the upper rolling roller 21 includes a first cylindrical surface 31 whose width extends in parallel with the first roller axis X1, and left and right outer taper surfaces 33, which respectively extend along ends (circumferences) of the first cylindrical surface 31 toward radially outer direction of the upper rolling roller 21 so as to be inclined relative to the radial direction of the upper rolling roller 21 by the same angle.

The second outer circumferential surface 20 of the lower rolling roller 22 is formed with a second cylindrical surface 32 whose width extends in parallel with the second roller axis X2 for the same length as the first cylindrical surface 31, and left and right inner taper surfaces 34, which respectively extend along ends (circumferences) of the second cylindrical surface 32 in the radially inner direction of the lower rolling roller 22 so as to be inclined relative to the radial direction of the lower rolling roller 22 by the same angle as the outer taper surfaces 33 of the upper rolling roller 21. Thus, the second outer circumferential surface 20 of the lower rolling roller 22 is engaged with the first outer circumferential surface 19 of the upper rolling roller 21 at the rolling portion 28. Further, the circumferential rolling grooves 17, 18 are formed at the cylindrical surfaces 31, 32, respectively.

The restricting portion 30 may be modified to be configured as follows. Instead of forming the left and right outer taper surfaces 33, left and right first right-angled surfaces, which extend orthogonally relative to the first cylindrical surface 31, may be formed at the upper rolling roller 21. Further, instead of forming the left and right inner taper surfaces 34, left and right second right-angled surfaces, which extend orthogonally relative to the second cylindrical surface 32, may be formed at the lower rolling roller 22. Then, a portion between the second right-angled surfaces of the lower rolling roller 22 may be inserted between the first right-angled surfaces of the upper rolling roller 21 so that the first and second right-angled surfaces engage with each other. Thus, the restricting portion restricts displacement of the pair of rolling rollers 21, 22 relative to each other in an axial direction of the roller axes X1, X2.

However, compared to the restricting portion, having the right-angled surfaces, the restricting portion 30, having the inner taper surfaces 33 and the outer taper surfaces 34, requires less driving load, and accordingly, a roller driving mechanism requires less output power. in other words, according to the restricting portion, having the right-angled surfaces, the first right-angled surfaces of the upper rolling roller 21 and the second right-angled surfaces of the lower rolling roller 22 contact each other in plane. Therefore, large sliding resistance is generated when the pair of the rolling rollers 21, 22 rotates, and as a result, a large driving load is required. On the other hand, according to the restricting portion 30, having the inner taper surfaces 33 and the outer taper surfaces 34, the inner taper surfaces 33 and the outer taper surfaces 34 contact each other in line in the radial direction of the rolling rollers 21, 22. Therefore, smaller sliding resistance is generated when the pair of the rolling rollers 21, 22 rotate, and as a result, less driving load is required.

[Second Embodiment]

Figure 5:
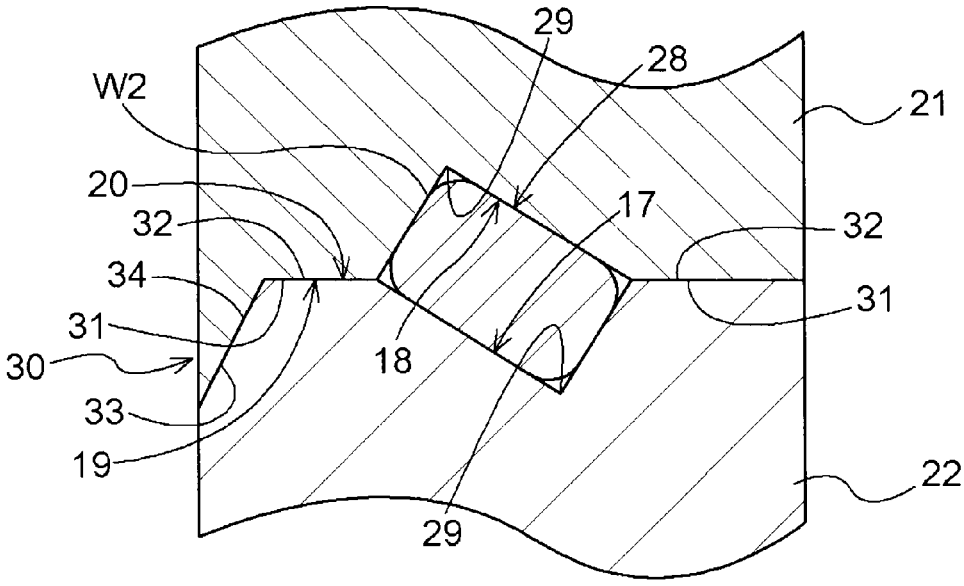
FIG. 5 is an enlarged view illustrating a main portion according to a second embodiment.

FIG. 5 illustrates a second embodiment of the restricting portion 30. The first outer circumferential surface 19 of the upper rolling roller 21 is formed with a first cylindrical surface 31, whose width extends in parallel with the first rolling axis X1, and outer taper surface 33, which extends along one end (one of circumferences) of the first cylindrical surface 31 in the radially outer direction of the upper rolling roller 21 so as to be inclined relative to the radial direction of the upper rolling roller 21.

The second outer circumferential surface 20 of the lower rolling roller 22 is formed with a second cylindrical surface 32, whose width extends in parallel with the second rolling axis X2 for the same length as the first cylindrical surface 31, and an inner taper surface 34, which extends along one end (one of circumferences) of the second cylindrical surface 32 in the radially inner direction of the lower rolling roller 22 so as to be inclined relative to the radial direction of the rolling roller by the same angle as the outer taper surface 33 of the upper rolling roller 21.

The outer taper surface 33 of the upper rolling roller 21 contacts the inner taper surface 34 of the lower rolling roller 22 in the axial direction of the roller axes X1, X2 at one side of the rolling portion 28 in a width direction of the groove. Thus, the restricting portion 30 is configured to restrict the displacement of the pair of rolling rollers 21, 22 in the axial direction. Other configurations of the restricting portion 30 are the same as the first embodiment.

[Other Embodiments]

According to the roller dice device, the pair of rolling rollers may be rotatably supported so that the outer circumferential surfaces thereof do not contact each other.

According to the roller dice device, the restricting portion may be modified so that a ring-shaped protruding portion, formed at one of the outer circumferential surfaces engages with a ring-shaped recessed-portion, formed at the other of the outer circumferential surfaces. The restricting portion may be thus configured to restrict the displacement of the pair of rolling rollers in the axial direction.

According to the roller dice device, the restricting portion may be modified so that tooth portions, formed at one of the outer circumferential surfaces so as to include the same interval between each other in a circumferential direction of the rolling roller, engage with a ring-shaped recessed-portion, formed at the other of the outer circumferential surfaces (or, recessed portions, formed at the other of the outer circumferential surfaces so as to include the same interval between each other in the circumferential direction of the rolling roller). The restricting portion may be thus configured to restrict the displacement of the pair of rolling rollers in the axial direction.

The roller dice device may be used to process a metal-made rolling material other than a metal wire rod.

The roller dice device may be used to process a tubular-shaped metal rolling material.

According to the roller dice device, the restricting portion may be modified as follows: one of the outer circumferential surfaces is formed with a first cylindrical surface, whose width extends in parallel with the axial direction of the rolling roller, and a pair of outer taper surfaces, which respectively extend along ends (circumferences) of the first cylindrical surface in the radially outer direction of the rolling roller so as to be inclined relative to the radial direction of the rolling roller. The other of the outer circumferential surfaces is formed with a second cylindrical surface, whose width extends in parallel with the axial direction of the rolling roller, and one inner taper surface, which extends along one end (one of circumferences) of the second cylindrical surface in the radially inner direction of the rolling roller so as to be inclined relative to the radial direction of the rolling roller. The restricting portion may be thus configured to restrict the displacement of the pair of rolling rollers in the axial direction.

Accordingly, when a rolling material moves through a rolling portion 28, a reaction force, which includes a component force in the axial direction of the rolling rollers 21, 22, may be applied to each of the circumferential rolling grooves 17, 18 of the pair of rolling rollers 21, 22. However, the circumferential rolling grooves 17, 18 are less likely to be displaced relative to each other in the width direction of the grooves. As a result, the rolling material is processed accurately so as to have a desired-shaped cross-section.

According to the first and second embodiments, the pair of rolling rollers 21, 22 is rotatably supported in a manner where the outer circumferential surfaces 19, 20 thereof contact each other. Each of the circumferential rolling grooves 17, 18 is formed to have a right-triangle-shaped cross-section so that the spaced portion is formed into a rectangular-shaped hole when seen in a moving direction of the rolling material.

Accordingly, the rolling material may be processed to have the rectangular-shaped cross-section. When an insulator electric wire, processed in the roller dice device A according to the embodiments, is wound around an insulator member so as to form a coil, less clearance is generated in the wound electric coil. Consequently, a coil may be formed, which have the rectangular-shaped cross-section so as to include a high space factor. "Rectangular" mentioned herein refers to a quadrangle, which has four straight sides and four 90-degree angles, such as a square having four equal sides, or a rectangle having two longer sides and two shorter sides.

According to the first and second embodiments, the restricting portion 30 includes the first cylindrical surface 31 formed at one of the outer circumferential surfaces 19, 20 to be in parallel with the roller axes X1, X2, the outer taper surface 33 extending along the end of the first cylindrical surface 31 toward the radially outer direction of one of the rolling rollers 21, 22, the second cylindrical surface 32 formed at the other of the outer circumferential surfaces 19, 20 to be in parallel with the roller axes X1, X2, and the inner taper surface 34 extending along the end of the first cylindrical surface 32 toward the radially inner direction of one of the rolling rollers 21, 22. The outer taper surface 33 contacts the inner taper surface 34 in the axial direction of the roller axes X1, X2 so that the restricting portion 30 restricts the displacement of the pair of rolling rollers 21, 22.

Accordingly, the rolling material may be processed to have the rectangular-shaped cross-section. In order to form the rolling material to have the rectangular-shaped cross-section by means of the circumferential rolling grooves 17, 18, having right-triangle-shaped cross-section, two inequilateral right triangle shapes of the circumferential rolling grooves 17, 18 form a rectangular shape when seen in the cross-sectional view thereof. Therefore, while the rolling material, having the circular-shaped cross-section, moves through the rolling portion 28, a larger reaction force may be generated at the longer sides of the circumferential rolling grooves 17, 18. Consequently, the circumferential rolling grooves 17, 18 may easily be displaced at the rolling portion 28 in a direction where the corner portions 29 of the bottom surfaces of the circumferential rolling grooves approach close to each other. Further, even in a case where each of the circumferential rolling grooves 17, 18 is formed into an isosceles right triangle shape when seen in the cross-sectional view thereof, depending on forming conditions and accuracy of assembly of the rolling rollers, the pair of rolling rollers 21, 22 may be displaced relative to each other in a width direction of the circumferential rolling grooves. Accordingly, the circumferential rolling grooves 17, 18 may be displaced relative to each other at the rolling portion 28 in the direction where corner portions 29 of the bottom surfaces of the circumferential rolling grooves approach close to each other. Therefore, according to the first and second embodiments, the restricting portion 30 is provided, which includes the first cylindrical surface 31 formed at one of the outer circumferential surfaces 19, 20 to be in parallel with the roller axes X1, X2, the outer taper surface 33 extending along the end of the first cylindrical surface 31 toward the radially outer direction of one of the rolling rollers 21, 22, the second cylindrical surface 32 formed at the other of the outer circumferential surfaces 19, 20 to be in parallel with the roller axes X1, X2, and the inner taper surface 34 extending along the end of the first cylindrical surface 32 toward the radially inner direction of one of the rolling rollers 21, 22. Consequently, the outer taper surface 33 contacts the inner taper surface 34 in the axial direction of the roller axes X1, X2 so that the restricting portion 30 restricts the displacement of the pair of rolling rollers 21, 22. Accordingly, displacement of the circumferential groove portions 17, 18 relative to each other in the width direction of the grooves is less likely to occur and the rolling material may be more accurately formed to have the rectangular-shaped cross-section.

According to the first and second embodiments, the restricting portion 30 includes the first cylindrical surface 31 formed at one of the outer circumferential surfaces 19, 20 to be in parallel with the roller axes and formed at both side of the rolling roller in a direction of the rollers axes X1, X2, the outer taper surface 33 extending along both ends of the first cylindrical surface 31 in the direction of the rollers axes toward a radially outer direction of one of the rolling rollers 21, 22, the second cylindrical surface 32 formed at the other of the outer circumferential surfaces 19, 20 to be in parallel with the roller axes and formed at both side of the rolling roller in the direction of the rollers axes X1, X2, and the inner taper surface 34 extending along both ends of the second cylindrical surface 32 in the direction of the rollers axes X1, X2 toward a radially inner direction of one of the rolling rollers 21, 22.

According to the first and second embodiments, the winding apparatus B, having the roller dice device A includes the roller dice device A, the winding device 7 winding a rolled wire, rolled to have a rectangular-shaped cross-section by means of the roller device A, around the bobbin 6, and the tension adjusting device 3 adjusting the tension of the rolled wire, moving from the roller dice device A to the winding device 7.

Accordingly, the rolling wire, having the rectangular-shaped cross-section, is accurately formed. Further, when the rolling wire is wound to form the insulator coil, a coil, which includes a high space factor, may be more easily manufactured.

According to the first and second embodiments, the method for manufacturing an insulator coil, using the roller dice device includes the wire supplying process for supplying the wire for the insulator coil to the rolling portion 28, the rolling process for rolling the wire, supplied to the rolling portion 28, to have a rectangular-shaped cross-section, and the winding process for winding the rolled wire, rolled to have the substantially rectangular-shaped cross-section in the rolling process, so as to form the insulator coil.

Accordingly, the pair of rolling rollers 21, 22, each of which has the right-triangle-shaped circumferential rolling groove 17, 18, is used so that the rolling portion 28 is formed into the rectangular-shaped hole when seen in the cross-sectional view thereof. Therefore, when seen in the cross-sectional view, a contacting surface, where the pair of rolling rollers 21, 22 contacts each other, is positioned at an extension of a diagonal line of the rectangular-shaped cross-section of the rolling wire. Accordingly, the contacting surface of the pair of the rolling rollers 21, 22 is positioned at the corner portions 29 of the rectangular-shaped wire. As a result, deformation of a cross-section of the wire due to a rolling force is less likely to occur.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A roller dice device comprising:

a pair of rolling rollers respectively including circumferential rolling grooves formed at outer circumferential surfaces thereof;

a supporting portion rotatably supporting the pair of rolling rollers respectively around roller axes extending in parallel with each other;

a spaced portion configured by a rolling portion, through which a rolling material moves, and formed by the circumferential rolling grooves facing each other;

a restricting portion formed at the outer circumferential surfaces of the pair of the rolling rollers and restricting displacement of the pair of rolling rollers relative to each other in the axial direction of the roller axes, wherein the restricting portion includes a first cylindrical surface formed at one of the outer circumferential surfaces to be in parallel with the roller axes, an outer taper surface extending along an end of the first cylindrical surface toward a radially outer direction of one of the rolling rollers, a second cylindrical surface formed at the other of the outer circumferential surfaces to be in parallel with the roller axes, and an inner taper surface extending along an end of the second cylindrical surface toward a radially inner direction of one of the rolling rollers, wherein the first cylindrical surface is formed at both sides of the rolling roller in a direction of the rollers axes across the circumferential rolling groove, wherein the second cylindrical surface is formed at both sides of the rolling roller in the direction of the rollers axes across the circumferential rolling groove, wherein each of the first cylindrical surfaces is provided between the circumferential rolling groove and the outer taper surface in the axial direction of the roller axes to directly connect to the circumferential rolling groove and the outer taper surface, wherein each of the second cylindrical surfaces is provided between the circumferential rolling groove and the inner taper surface in the axial direction of the roller axes to directly connect to the circumferential rolling groove and the inner taper surface, and wherein the outer taper surface contacts the inner taper surface in the axial direction of the roller axes so that the restricting portion restricts the displacement of the pair of rolling rollers.

* * * * *